US005082482A

United States Patent [19]

Darredeau

[11] Patent Number: 5,082,482

[45] Date of Patent: Jan. 21, 1992

[54] PROCESS AND APPARATUS FOR THE PRODUCTION OF GASEOUS OXYGEN WITH A VARIABLE FLOW BY AIR DISTILLATION

[75] Inventor: Bernard Darredeau, Sartrouville, France

[73] Assignee: L'Air Liquide, Societe Anonyme pour l'Etude et l'Exploitation des Procedes Georges Claude, Paris, France

[21] Appl. No.: 584,241

[22] Filed: Sep. 18, 1990

[30] Foreign Application Priority Data

Oct. 9, 1989 [FR] France ..... 89 131159

[51] Int. Cl.[5] ..... F25J 3/02

[52] U.S. Cl. ..... 62/24; 62/41; 62/43

[58] Field of Search ..... 62/11, 13, 24, 41, 43

[56] References Cited

U.S. PATENT DOCUMENTS

| | | | |
|---|---|---|---|
| 2,846,853 | 8/1958 | Matsch | 62/43 |
| 2,915,882 | 12/1959 | Schuftan et al. | 62/43 |
| 2,997,854 | 8/1961 | Schilling et al. | 62/13 |
| 3,174,293 | 3/1965 | Jakob et al. | 62/41 |
| 3,210,948 | 10/1965 | Schilling et al. | 62/13 |
| 3,214,925 | 11/1965 | Becker | 62/41 |
| 4,133,662 | 1/1979 | Wagner | 62/13 |
| 4,372,764 | 2/1983 | Theobald | 62/41 |

FOREIGN PATENT DOCUMENTS

| | | |
|---|---|---|
| 1250848 | 9/1967 | Fed. Rep. of Germany . |
| 2335809 | 7/1977 | France . |
| 1178006 | 1/1970 | United Kingdom . |

*Primary Examiner*—Ronald C. Capossela
*Attorney, Agent, or Firm*—Young & Thompson

[57] ABSTRACT

To meet the requirement of a variable demand of gaseous oxygen, a constant flow of liquid oxygen is sent from the double distillation column into a container, and a variable flow of liquid oxygen is withdrawn therefrom, which is thereafter vaporized in a heat exchanger by condensation of a corresponding flow of incoming air. The liquefied air is stored in a second container, from which a constant flow of liquefied air is sent into the double column.

8 Claims, 2 Drawing Sheets

PROCESS AND APPARATUS FOR THE PRODUCTION OF GASEOUS OXYGEN WITH A VARIABLE FLOW BY AIR DISTILLATION

BACKGROUND OF INVENTION (a) Field of the Invention

The present invention relates to the production of a variable flow of gaseous oxygen by air distillation. The invention is first concerned with a process in which a variable quantity of oxygen is stored in liquid form in a first container from which a variable flow of oxygen is taken and vaporized with corresponding storing of another fluid in liquid form in a second container.

(b) Description of Prior Art

In a known process of this type, which is carried out in existing apparatuses and which is known under the designation "bascule process", the vaporization and the condensation of oxygen correspond to a condensation and a vaporization of nitrogen, heat exchanges being carried out in the double column which constitutes the air distillation apparatus. Thereafter, each modification of the flow of gaseous oxygen produced, is accompanied by a modification of the operating conditions of the double column, and in particular of its heating and reflux coefficients. There follow periods of losses of efficiency of the distillation, which are more important when the variations of the operating conditions are close and fast. Moreover, a complex regulation of the apparatus is necessary.

SUMMARY OF INVENTION

The invention aims at providing a process which can be carried out in a more simple manner.

For this purpose, it is an object of the present invention to provide a process of the type mentioned above, characterized in that said fluid consists of a fraction of the air to be treated, a constant flow of liquid oxygen is sent in said first container and the constant flow of liquefied air from said second container is sent into the distillation device, and in that a variable flow of liquid oxygen is withdrawn from the first container, depending on the demand of gaseous oxygen, said liquid oxygen being vaporized by condensation of a corresponding variable flow of air to be treated.

According to an advantageous embodiment, when the demand of oxygen varies, the flows of each fluid introduced into the distillation device and of each flow withdrawn from this device are maintained constant, and the total flow of air to be treated varies similarly as the flow of air which is condensed by vaporization of oxygen.

It is also an object of the invention to provide an apparatus intended to carry out such process. This apparatus, of the type comprising a main air compressor, a double column distillation device fed by this compressor, a first container for storing a variable quantity of liquid oxygen, a second container for storing a variable quantity of another fluid in liquid form, and means for taking a variable flow of liquid oxygen in the first container and to vaporize the same and, substantially at the same time, adding said fluid in liquid form in the second container, is characterized in that said vaporization means comprise a heat exchanger connected on the one hand to the outlet of the main compressor and on the other hand to the second container, the lower part of the latter being on the other hand connected to the distillation device, and in that the apparatus comprises means to feed a constant flow of liquid oxygen to the first container, means to take a variable flow of liquid oxygen from this container, means to produce a variation of the flow of air sent to the heat exchanger, and means to send a constant flow of liquefied air from the second container to the distillation device.

BRIEF DESCRIPTION OF DRAWINGS

Examples of operating the invention will now be described with reference to the annexed drawings, in which.

DESCRIPTION OF PREFERRED EMBODIMENTS

Figure 1:
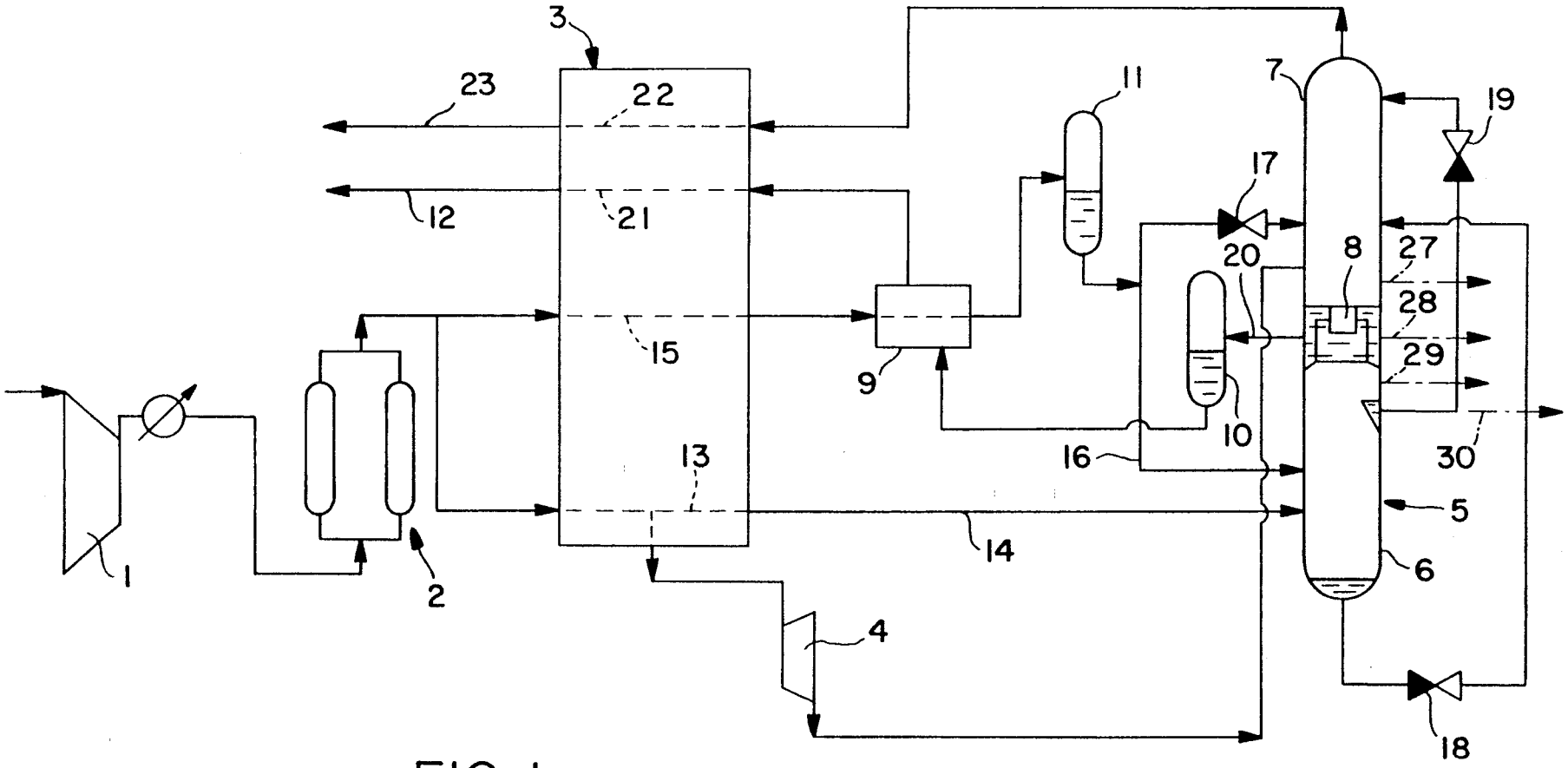
FIGS. 1 and 2 are schematic representations of two embodiments of the apparatus according to the invention.

The apparatus represented in FIG. 1 essentially comprises a main air compressor 1 with variable flow, for example of the centrifuge type with movable bladings, a device 2 for purification by adsorption, a heat exchange line 3, a turbine 4 to maintain cold conditions, an air distillation device 5 consisting of a double column which has a mean pressure column 6 surmounted with a low pressure column 7 and a vaporizer-condenser 8, an auxiliary heat exchanger 9, a container for liquid oxygen 10 and a container for liquefied air 11. This apparatus is intended to produce a variable flow of gaseous oxygen via a duct 12, under a pressure which is slightly above atmospheric pressure.

To describe the operation of this apparatus, it will be assumed first that the demand of gaseous oxygen in duct 12 is constant and equal to the nominal production, that is 20% of the flow of nominal air compressed by the compressor 1. In all of the present specification, the pressures indicated are approximate absolute pressures, and the flows are molar flows.

The nominal flow of air to be treated, compressed at 6 bars by compressor 1, cooled at room temperature and purified in device 2, is divided into two fluxes each having a constant flow:

A first flux is cooled in ducts 13 of the exchange line; a portion is removed from this exchange line after partial cooling, it is expanded at about 1 bar in turbine 4 and is blown into low pressure column 7, at about its dew point; the remaining portion continues to be cooled until reaching its dew point under 6 bars, after which it is blown at the bottom of the low pressure column 6 via duct 14.

A second flux is cooled, until reaching about its dew point, in ducts 15 of the exchange line after which it is condensed in the exchanger 9 and stored in liquid form in container 11. A constant flow of liquefied air is withdrawn from the bottom of this container and is divided into a first constant flow under 6 bars which is sent to the mean pressure column via duct 16, and a second constant flow expanded at about 1 bar in an expansion valve 17 which is thereafter injected in low pressure column 7.

The vaporizer-condenser 8 vaporizes a constant flow of liquid oxygen in the vat portion of the low pressure column by condensation of a substantially equal flow of nitrogen from the head portion of the mean pressure column. "Rich liquid" (oxygen enriched air) taken in the bottom portion of the mean pressure column and expanded at about 1 bar in an expansion valve 18 is injected at an intermediate level of the low pressure column, and "poor liquid" (substantially pure nitrogen) taken in the head portion of the mean pressure column and expanded at about 1 bar in expansion valve 19 is injected at the top of the low pressure column.

A constant flow of liquid oxygen, corresponding to 20 % of the flow of incoming air, is sent, via duct 20, into container 10. An identical constant flow of liquid oxygen is withdrawn from the bottom of this container, vaporized in the exchanger 9, warmed in ducts 21 of the exchange line and sent to production duct 12. In addition, a constant flow of impure nitrogen, withdrawn from the top of the low pressure column, is warmed in ducts 22 of the exchange line and removed as residue via duct 23.

All the ducts which end at the double column 5 and all those which start therefrom are provided with means (not represented) ensuring a constant flow. Thus, when the demand of gaseous oxygen varies, the adjustment of this double column is not modified.

On the other hand, in this case, the flow of air condensed in exchanger 9 varies, and the position of the movable blades of the compressor 1 is correspondingly modified.

Thus, if the demand in gaseous oxygen increases, a larger flow of oxygen is vaporized in exchanger 9. This increases the flow of air which is condensed in this exchanger, which creates a request for additional air towards this exchanger, in ducts 15 of this exchange line. The adjustment of the blades of the compressor 1 is then modified so as to permit this additional flow of air. The level of liquid in the container 10 lowers, and it increases in the container 11.

Inversely, if the demand in gaseous oxygen decreases, a reduced flow of oxygen is vaporized in exchanger 9. This reduces the flow of air condensed in this exchanger, and consequently also the flow of air circulating in ducts 15 of the exchange line. The adjustment of the blades of the compressor 1 is then modified so as to proportionally decrease the flow of atmospheric air sucked in.

It will therefore be seen that it is possible to respond to the variation of the demand of gaseous oxygen by a simple modification of the adjustment of the blades of compressor 1, which can be carried out simply and nearly instantaneously, without disturbing in any way the operation of the distillation device 5. Moreover, this flexibility is obtained without using any product resulting from the separation of air during variations of the gaseous oxygen produced.

Figure 2:
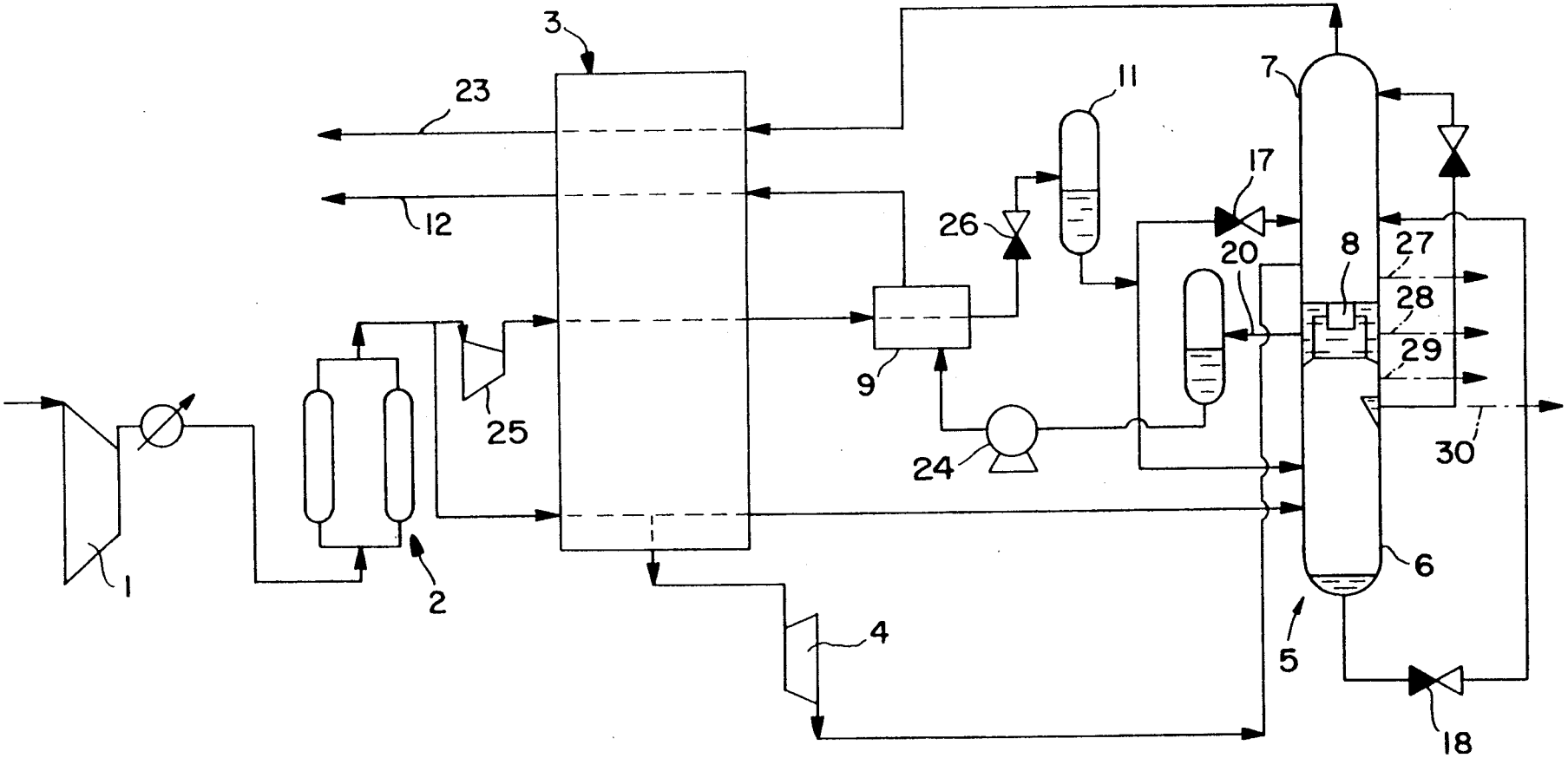

The apparatus illustrated in FIG. 2 is adapted to supply gaseous oxygen under pressure, and differs from the previous one only by the fact that a pump 24 with variable flow is mounted in the duct which connects the bottom of the container 10 to the exchanger 9, and an air booster 25 with movable blades is mounted in the duct which carries the fraction of the flow of compressed air to ducts 15 of the heat exchange line.

The nominal operation of the apparatus is the same as the previous one, except that liquid oxygen is withdrawn from the container 10 and is brought to desired pressure by means of pump 24, after which it is vaporized under this pressure in exchanger 9. To carry out this vaporization, the corresponding flow of air is overpressurized at a pressure which is somewhat higher than the vaporization pressure of oxygen by means of booster 25, it is condensed in exchanger 9, after which it is expanded at 6 bars in an expansion valve 26 before being stored in container 11.

In this case, each variation in the demand of gaseous oxygen in duct 12 requires a corresponding variation of the flow of pump 24, a variation of the same order of the flow of overpressurized air by means of booster 25, and an identical variation of the flow of compressed air by means of the main compressor 1.

These modifications of the adjustment of the rotating elements are again simple to obtain and are nearly instantaneous, and they produce no disturbance of the operation of the double column nor any loss of product.

Because of its simplicity and efficiency, the invention is particularly suitable for giving flexibility to apparatuses for the production of oxygen with demands of oxygen which frequently and rapidly vary.

It should be noted that the invention is also applicable to the case where, the demand of oxygen is always superior to a given minimum value, in which case a constant flow of gaseous oxygen equal to that minimum value is directly withdrawn from the base of the low pressure column 7 via a duct 27, as indicated in mixed line in FIGS. 1 and 2, and is then warmed in the exchange line. This variant enables to reduce the capacities of containers 10 and 11. Also, constant productions of liquid oxygen and/or gaseous nitrogen and/or liquid nitrogen may be simultaneously obtained by means of the double column, via ducts 28 and/or 29 and/or 30, also as indicated in mixed line in FIGS. 1 and 2.

We claim:

1. An air distillation process for producing gaseous oxygen at variable flow rates which comprises the following steps:

providing a first stream of air under pressure at a variable selected flow rate;

dividing the first stream into a second and a third stream;

the second and third streams in a first heat exchanger;

forwarding the cooled second stream of air to a distillation column;

passing the cooled third stream of air through a second exchange for liquefaction and collecting the resulting liquid air in a first storage tank;

supplying at a constant flow rate liquid air withdrawn from the first storage tank to the distillation column;

withdrawing at a constant flow rate liquid oxygen from the distillation column and feeding it to a second storage tank;

withdrawing liquid oxygen from the second storage tank at a variable flow rate depending upon demand;

vaporizing the withdrawn oxygen in the second heat exchanger; and warming the vaporized oxygen in the first exchanger for distribution.

2. The process of claim 1, which comprises the step of varying the flow rate of the first stream of air in accordance with the variations of the flow rate of oxygen withdrawn from the second storage tank.

3. The process of claim 1, further comprising the steps of:

increasing the pressure of liquid oxygen withdrawn from the second storage tank before passing through the second heat exchanger, and overpressurizing accordingly the third stream of air before passing through the first heat exchanger.

4. An air distillation process for producing gaseous oxygen at variable flow rates which comprises providing a stream of air under pressure at a variable selected flow rate, cooling and liquefying the stream of air in a heat exchanger, storing the liquefied air in a storage tank, withdrawing liquefied air from the storage tank and feeding it to an air distillation column at a constant flow rate, withdrawing liquid oxygen from the distillation column at a constant flow rate and storing it in a second storage tank, withdrawing liquid oxygen from the second storage tank at a variable flow rate and vaporizing it in said heat exchanger, said variable flow rate of the air varying as said variable flow rate of the liquid oxygen.

5. The apparatus of claim 4, further comprising a pump in the duct.

6. An air distillation apparatus for producing gaseous oxygen at variable flow rates, comprising:

a double distillation column having at least one gaseous air inlet, at least one liquid air inlet and at least one liquid oxygen outlet;

a first and a second heat exchangers;

a first and a second storage tanks, each having an inlet and an outlet;

a duct between the inlet of the first storage tank and the liquid oxygen outlet;

an oxygen distribution line extending from the outlet of the first storage tank and passing successively through the second and first heat exchangers;

at least a first air feeding line passing through the first heat exchanger and connected to the gaseous air inlet;

a second air feeding line passing successively through the first and second heat exchangers and connected to the inlet of the second storage tank;

at least one liquid air line extending between the outlet of the second storage tank and the liquid air inlet;

and a variable flow air compressor for supplying compressed air to the first and second air feeding lines.

7. The apparatus of claim 6, further comprising a variable flow suppressor in the second air feeding line.

8. An air distillation apparatus for producing gaseous oxygen at variable flow rates, comprising means for providing a stream of air under pressure at a variable selected flow rate, a heat exchanger for cooling and liquefying the stream of air, a storage tank for storing the liquefied air, an air distillation column, means for withdrawing liquefied air from the storage tank and feeding it to the air distillation column at a constant flow rate, means for withdrawing liquid oxygen from the distillation column at a constant flow rate, a second storage tank receiving the withdrawn liquid oxygen, and means for withdrawing liquid oxygen from the second storage tank at a variable flow rate and vaporizing it in said heat exchanger, said variable flow rate of the air varying as said variable flow rate of the liquid oxygen.

* * * * *